US005233847A

United States Patent [19]

Tanaka

[11] Patent Number: 5,233,847

[45] Date of Patent: Aug. 10, 1993

[54] WASHING MACHINE

[75] Inventor: Teruya Tanaka, Yokohama, Japan

[73] Assignee: Kabushiki Kaisha Toshiba, Kawasaki, Japan

[21] Appl. No.: 774,880

[22] Filed: Oct. 11, 1991

[30] Foreign Application Priority Data

Oct. 15, 1990 [JP] Japan ..... 2-275754

[51] Int. Cl.[5] ..... D06F 33/02

[52] U.S. Cl. ..... 68/12.04

[58] Field of Search ..... 68/12.01, 12.04

[56] References Cited

U.S. PATENT DOCUMENTS 5,092,140 3/1992 Matsuo et al. ..... 68/12.04

FOREIGN PATENT DOCUMENTS 61-185298 8/1986 Japan .

61-238395 10/1986 Japan .

62-224397 10/1987 Japan .

*Primary Examiner*—Philip R. Coe

*Attorney, Agent, or Firm*—Foley & Lardner

[57] ABSTRACT

Disclosed is a washing machine which comprises a DC brushless motor to drive a pulsator, an inverter circuit to generate outputs to drive the DC brushless motor by periodically switching input DC voltages with a switching device, an inverter controlling circuit for adjusting outputs of the inverter circuit by controlling the switching operation of the switching device in the inverter circuit, and a detecting mechanism for detecting laundry amount based on a rotating speed of the DC brushless motor and an inverter current flowing through the inverter circuit with the switching device under a constantly controlled state.

6 Claims, 7 Drawing Sheets

| A | LAUNDRY Q'TY |
|---|---|
| 630≦A | 5kg OR MORE |
| 630≦A <850 | 4~5kg |
| 850≦A <1300 | 3~4kg |
| 1300 ≦A | 2~3kg |

WASHING MACHINE

BACKGROUND OF THE INVENTION

1. Field of the Invention

The present invention relates to a laundry apparatus employing an inverter system in which a DC brushless motor drives a pulsator.

2. Description of the Prior Art

To perform effective and reliable washing, it is essential that the water amount, the water flow rate and the washing duration are set in accordance with the laundry amount.

Several detection methods have been proposed for laundry machines in which induction motors are utilized to drive pulsators. However, the rotating speed of induction motors is not adjustable. On the contrary, there are advantageous features in a washing machine having a DC brushless motor for driving the pulsator, such as an improved washing efficiency in that the rotating speed of the DC brushless motor is freely adjustable through an inverter circuit and noises produced from the motor become less the motor is of a brushless type.

Referring to FIG. 1, a conventional method for detecting the laundry amount is explained as follows.

Torque T is expressed by the following equation.

$$T = C_1 \cdot i \cdot B \cdot l \quad (1)$$

where, $C_1$: proportional constant, i: motor current,

B: flux density, l: conductor effective length.

Rotating speed N (rpm) is given by $$N = C_2 \cdot E / B \cdot l \quad (2)$$

where, $C_2$: proportional constant,

E: induction voltage

FIG. 1 shows the characteristics of rotating speed N over torque T (T-N characteristic) and average inverter current $I_{DC}$ over torque T (T-$I_{DC}$ characteristic) when the on-off duty ratio of transistors in an inverter circuit is 50%. The broken lines in FIG. 1 show the load lines for the laundry amount of 500 g, 2 kg and 5 kg, respectively.

In the conventional way of detecting the laundry amount, its amount is measured by the change in the average inverter current proportional to the torque, based on equation (1).

It is a well-known fact that the commercial power supply voltages fluctuate within the range of 10%, namely from 90 V to 110 V against the fixed 100 V. When this fluctuation occurs to the conventional washing machine, it will be difficult for the same laundry amount to be properly sensed since such a fluctuation in the commercial power supply voltage causes the average inverter current value to change as well. That is to say, when the commercial power supply voltage fluctuates in the usual manner, the different inverter current value is incorrectly detected for the laundry amount in question. Thus the motor rotates with a rotating speed based on the incorrect average inverter current value detected.

The laundry amount can also be detected by realizing a change in the rotating speed using equation (2). However, this method is also not reliable since it becomes hard to detect the laundry amount when the commercial power supply voltages fluctuate to cause the rotating speed to vary.

SUMMARY OF THE INVENTION

The present invention was made in view of the above-mentioned problems, therefore, it is an object thereof to provide a washing machine having a DC brushless motor which can accurately realize the laundry amount to carry out the washing process with the optimum water amount in accordance with the correctly detected laundry amount even though a fluctuation of commercial power supply voltages occurs within the usual range of about 10%.

To achieve the object, the washing machine according to the present invention comprises:

a DC brushless motor to drive a pulsator;

an inverter circuit having outputs which drive the DC brushless motor by means of periodically switching an input DC voltage with a switching device;

an inverter control circuit which controls the switching IC operation of the inverter circuit to adjust the output of the inverter circuit; and laundry detecting means for detecting the laundry amount on the basis of the correlation between the current flowing through the inverter circuit under the constant control state of the switching IC and the rotating speed of the DC brushless motor.

The motor current and the inverter current are so interrelated that, regardless of the level of commercial power supply voltages, the inverter's current characteristics remain unchanged against the torque under a control state of the switching device with a constant on-off duty ratio in the inverter-driven washing machines where a DC brushless motor is employed to drive the pulsator. Therefore, even in the event of usual commercial power supply voltage fluctuations, the laundry amount can be accurately sensed on the basis of the relation between the inverter current and rotating speed of the DC brushless motor, for instance, a ratio of rotating speed over inverter current. Incidentally, the ratio of rotating speed over the inverter current remains constant even in the range other than the 10% fluctuation of power supply voltage.

These and other objects, features and advantages of the present invention will be more apparent from the following description of the preferred embodiments, taken in conjunction with the accompanying drawings.

DETAILED DESCRIPTION OF THE PREFERRED EMBODIMENTS

Figure 1:
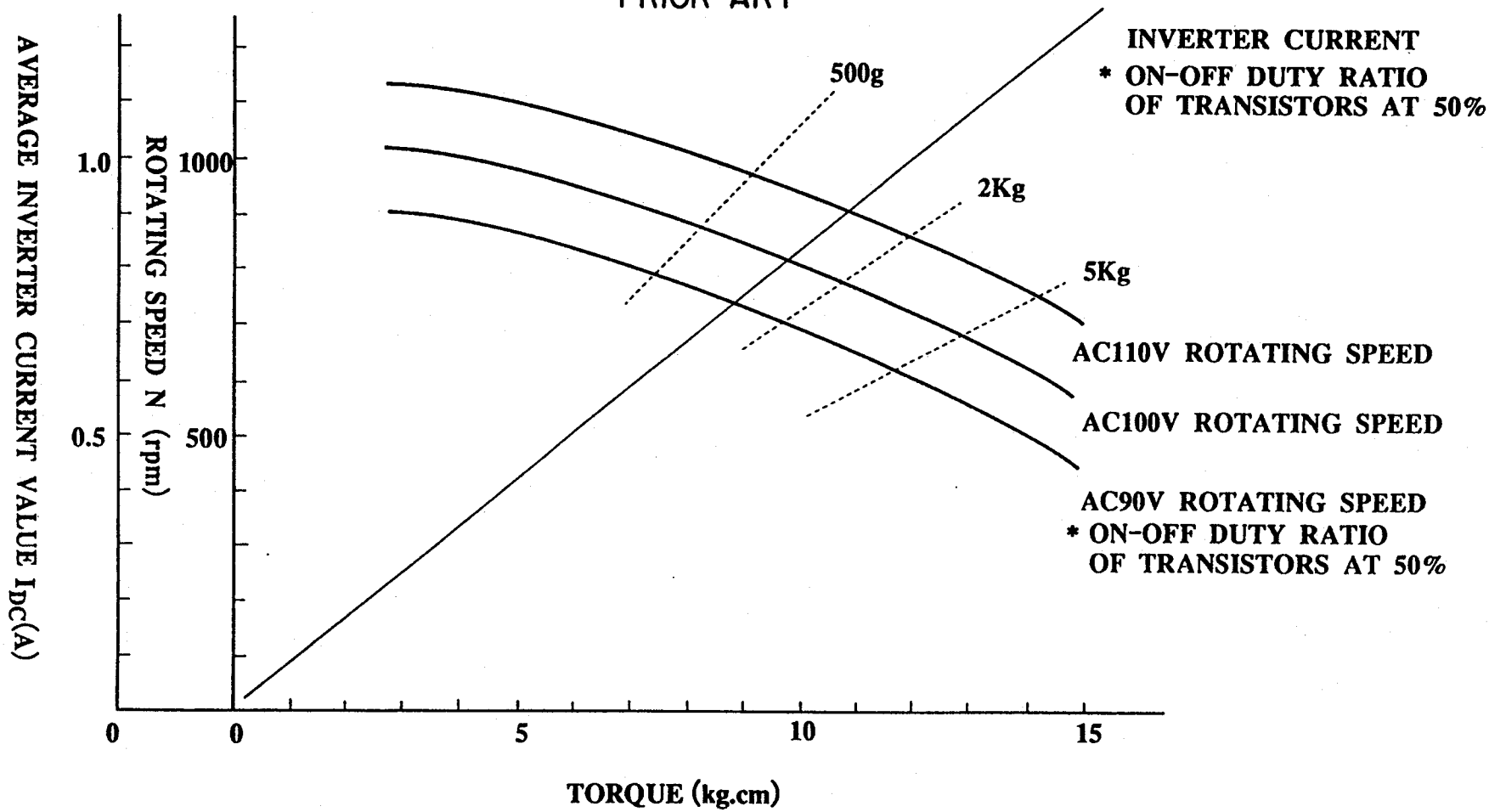
FIG.1 PRIOR ART
FIG. 1 is a graph showing a relation between the torque, the average inverter current and the rotating speed according to the conventional invention.
Figure 2:
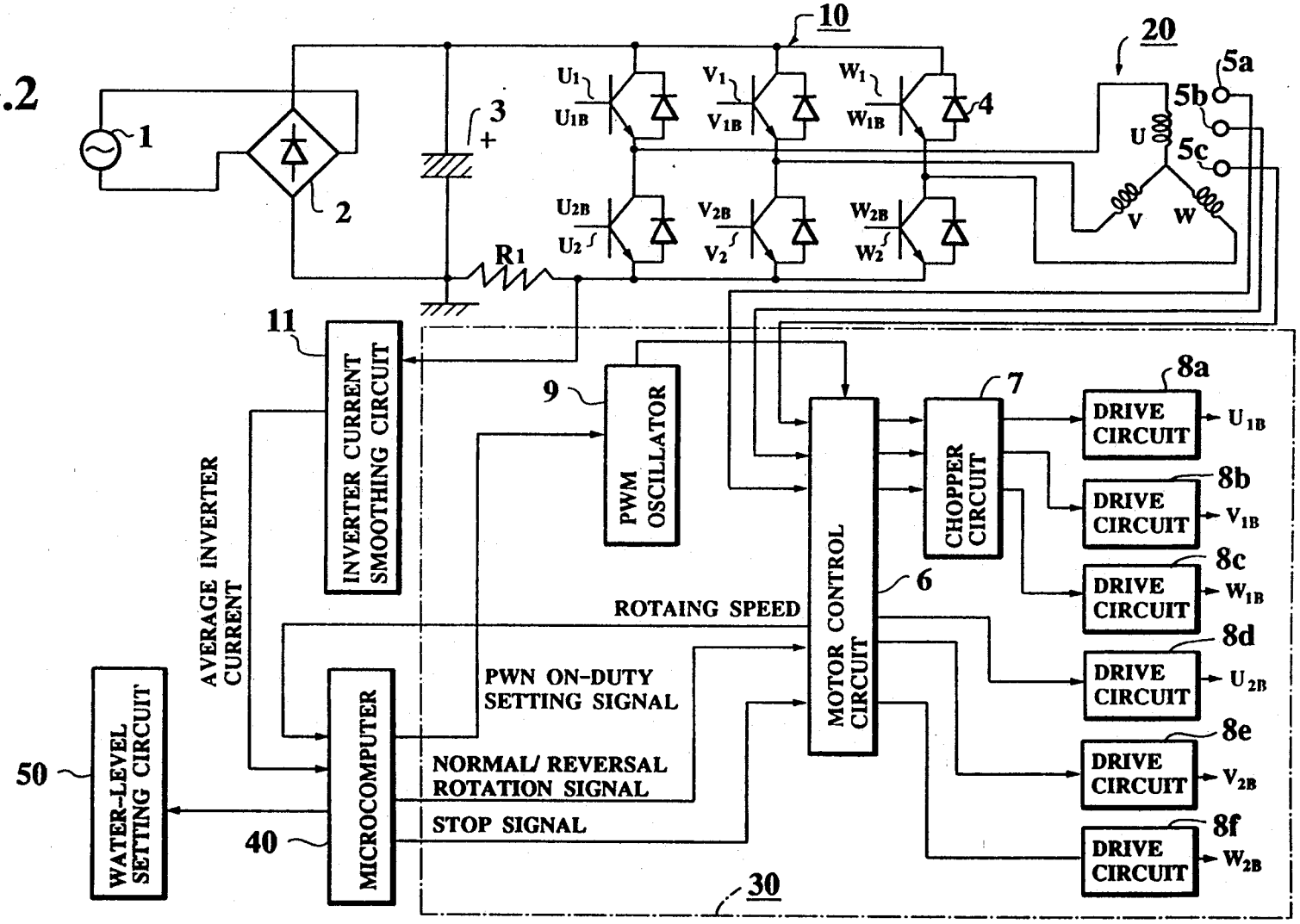
FIG. 2 is a circuit diagram showing an inverter circuit and an inverter controlling circuit and so on according to the first embodiment of the present invention.
Figure 7:
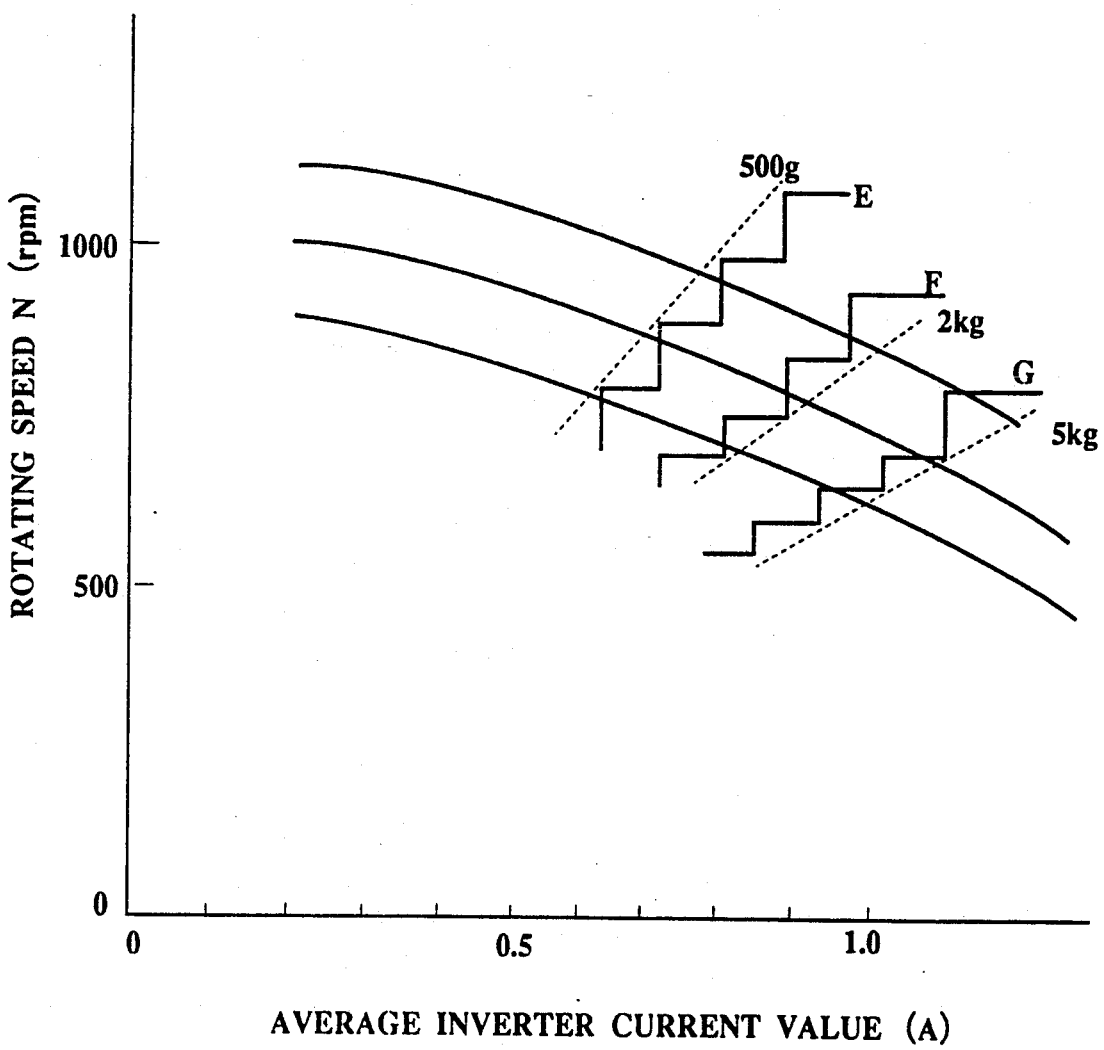
FIG. 7 is a graph showing a relation between the average inverter current and the DC brushless motor's rotating speed.

FIG. 2 and FIG. 7 show the first embodiment of the present invention.

Referring to FIG. 2, an embodiment of a washing machine in terms of the circuitry according to the present invention is explained as follows.

A portion marked as 10 is an inverter circuit. A portion 20 is a DC brushless motor that drives a pulsator. A portion 30 is an inverter controlling circuit for controlling the inverter. A portion 40 is a microcomputer for detecting the laundry amount. A portion 50 is a water-level setting circuit for setting up the optimum water level in a washing tank according to the laundry amount detected at the water-level setting circuit 50.

The brushless motor 20 utilized in this embodiment is equipped with armature windings u, v and w. A three-phase full-wave bridge type inverter is implemented to the brushless motor 20 in the inverter circuit 10. A portion 1 is a commercial AC power source for the three-phase full-wave bridge type inverter 10. The commercial AC power source 1 is connected to a rectifying bridge 2. Input DC voltages are produced after the AC components are rectified out by the rectifying bridge 2 and smoothed up by a smoothing capacitor 3. Such input DC voltages are converted into three-phase AC's by the three-phase full-wave bridge portion. Specifically, the six transistors $u_1$, $u_2$, $v_1$, $v_2$, $w_1$ and $w_2$ serving as switching devices are connected to the three pairs of arms corresponding to the three phases in the three-phase full-wave bridge portion. The three arms connected to the transistors $u_1$, $v_1$ and $w_1$ will be referred to as the upper arms and the other three arms connected to $u_2$, $v_2$ and $w_2$ the lower arms hereinafter. A free-wheel diode 4 is connected in parallel to each of transistors $u_1$, $v_1$, $w_1$, $u_2$, $v_2$ and $w_2$. The three points of contact between the upper and lower arms are connected to the three-phase armature windings u, v and w in the DC brushless motor 20.

The DC brushless motor 20 further comprises a rotor (not shown) containing the permanent magnet and three hall elements 5*a*, 5*b* and 5*c* for sensing the rotational position of rotor, besides the armature windings u, v and w. The information of the rotor position detected at the hall elements 5*a*, 5*b* and 5*c* are outputted to a motor control circuit 6 in the inverter controlling circuit 30. Outputs from the motor control circuit 6 are provided as drive signals to bases $u_{1B}$, $v_{1B}$ and $w_{1B}$ of upper arm transistors $u_1$, $v_1$ and $w_1$ by way of an amplifying chopper circuit 7 and drive circuits 8*a*, 8*b* and 8*c*. The outputs from the motor control circuit 6 are also provided as drive signals to bases $u_{2B}$, $v_{2B}$ and $w_{2B}$ of lower arm transistors $u_2$, $v_2$ and $w_2$ but by way of drive circuits 8*d*, 8*e* and 8*f* alone. The rotor position outputs detected at the hall elements 5*a*, 5*b* and 5*c* are logic-transformed by the motor control circuit 6 and then the drive signals are outputted sequentially turning on the transistors according to the rotor position, for example, with a cross combination of transistor $u_1$ in the upper arm and $v_2$ in the lower arm, $v_1$-$w_2$ and $w_1$-$u_2$ according to the rotor position. The input DC voltages are converted to three-phase AC by switching on the transistors, and then the currents flow sequentially through the armature windings u-v, v-w and w-u of the DC brushless motor in this order to rotate the brushless motor in one direction. The rotating directions (normal or reversal) is determined by the order of current supply among u, v and w. The rotating direction is controlled by signals from the microcomputer 40 by way of the motor control circuit 6.

A PWM (pulse width modulation) oscillator 9 is provided for adjusting the rotating speed of DC brushless motor 20. The PWM signals which were adjusted for on-off duty at a frequency of, say, 15 kHz based on the PWM ON duty setting signals from the microcomputer 40 are outputted repeatedly from the PWM oscillator 9. The PWM signals are provided to the upper arm transistors $u_1$, $v_1$ and $w_1$ through the amplifying chopper circuit 7 and the drive circuits 8*a*, 8*b*, 8*c*, so that the ON duration is regulated to adjust the rotating speed of the DC brushless motor 20. Specifically, the smaller the ON duration of the transistors $u_1$, $v_1$ and $w_1$ is, the lower the rotating speed of the DC brushless motor 20 becomes.

The DC brushless motor 20 stops when a stop signal from the microcomputer 40 sets all of the transistors of $u_1$, $v_1$, $w_1$, $u_2$, $v_2$ and $w_2$ to the OFF duration through the motor control circuit 6.

Figure 3:
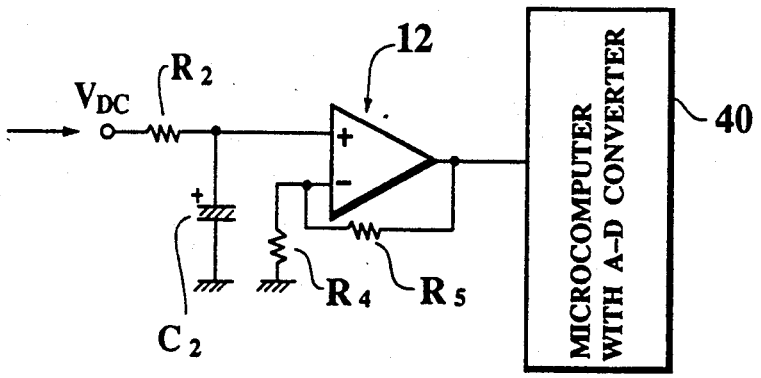
FIG. 3 is a circuit diagram showing wiring of an inverter current smoothing circuit in FIG. 2.

A resistance $R_1$ for detecting the inverter current is provided between the smoothing capacitor 3 of the three-phase full-wave bridge type inverter 10 and the three-phase full-wave bridge portion. The resistance $R_1$ converts the inverter current into a voltage $V_{DC}$. The voltage $V_{DC}$ is a pulse wave turned on or off at a frequency of, say, 15 kHz, to the effect that the voltage $V_{DC}$ is averaged by the inverter current smoothing circuit 11 and is read into the microcomputer 40 as digitized signals through an A-D converter. FIG. 3 shows the configuration of the current smoothing circuit 11 comprising a resistance $R_2$ and a capacitor $C_2$. The dynamic range of the A-D converter is 0–5 V, so that when the smoothed voltage is relatively small it will be amplified by an operational amplifier 12. The rotating speed of the DC brushless motor 20 is inputted in the microcomputer 40. The motor control circuit 6 operates to transform a rotor position detected output of the hall elements 5*a*, 5*b* and 5*c* into a signal pulse of the frequency proportional to the motor rotating speed. Such a pulse signal is read into the microcomputer 40 as a rotating speed signal of the DC brushless motor. The laundry amount is detected based on the averaged ratio of the rotating speed of DC brushless motor over the inverter current. Using the above detected signal outputs, the microcomputer 40 operates to set the optimum water level in the water tank according to the laundry amount detected. In the conventional method of using the average inverter current alone to adjust the motor rotating speed, the motor rotating speed and the motor voltage are changed concomitantly when the commercial power supply voltage fluctuates. However, as detailed above, the present invention can accurately detect the laundry amount in spite of the commercial power supply voltage fluctuation.

Figure 4:
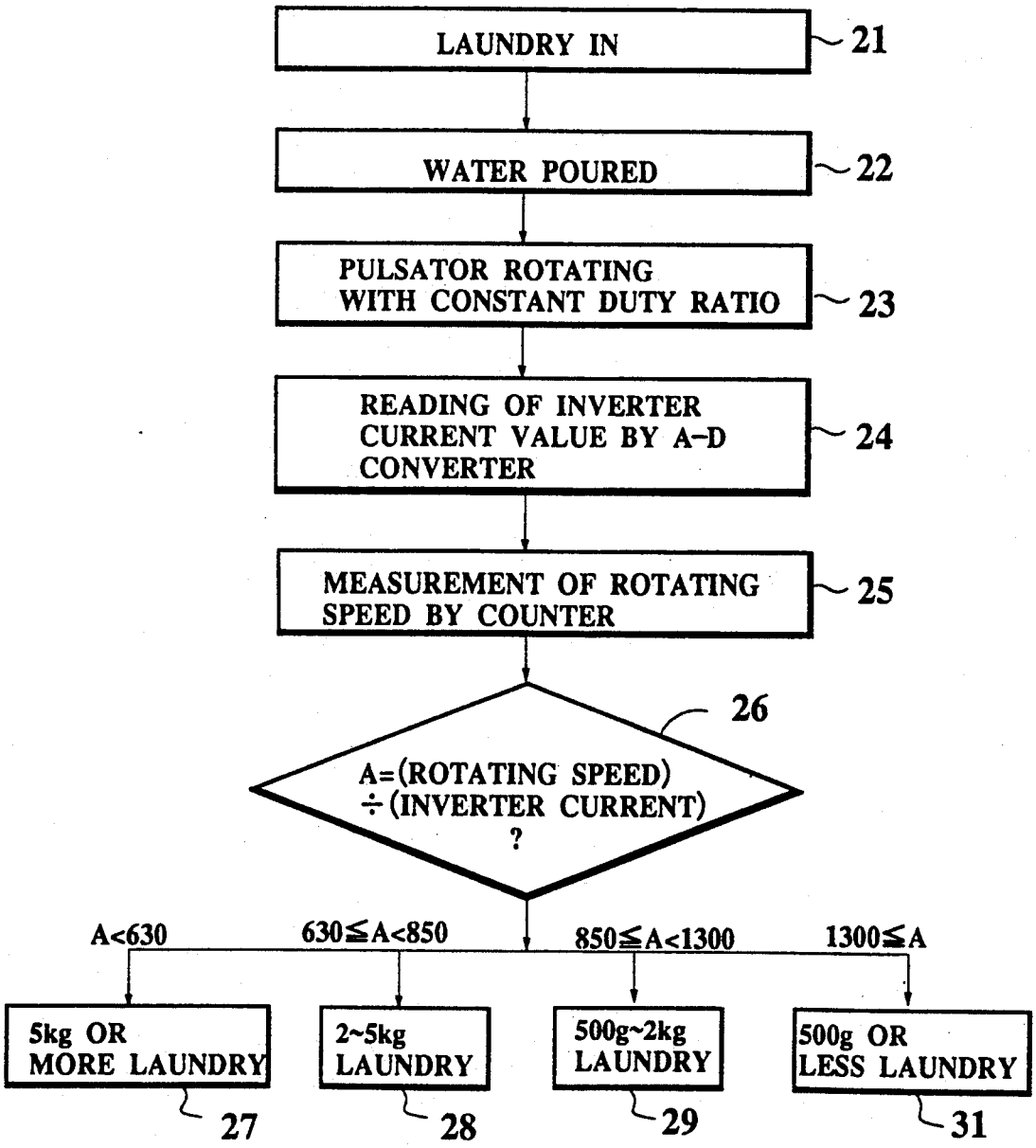
FIG. 4 is a flow chart showing the functional processes according to the present invention.

FIG. 4 indicates the function of the washing machine constructed in the above-described manner in the form of a flow chart.

A small amount of water is poured after items are put in the washing tank (step 21 and 22). This is because the presence of the water prevents the washing items from being damaged. The PWM on-duty setting signal becomes constant at, say, 50%, and then a pulsator is rotated by the DC brushless motor 20 (step 23). Then the rotating speed of the DC brushless motor 20 and the averaged value of the inverter current are read into the microprocessor 40 (step 24). Then, the amount of laundry is sensed based on the ratio of the rotating speed of the DC brushless motor 20 over the averaged value of the inverter current.

Figure 5:
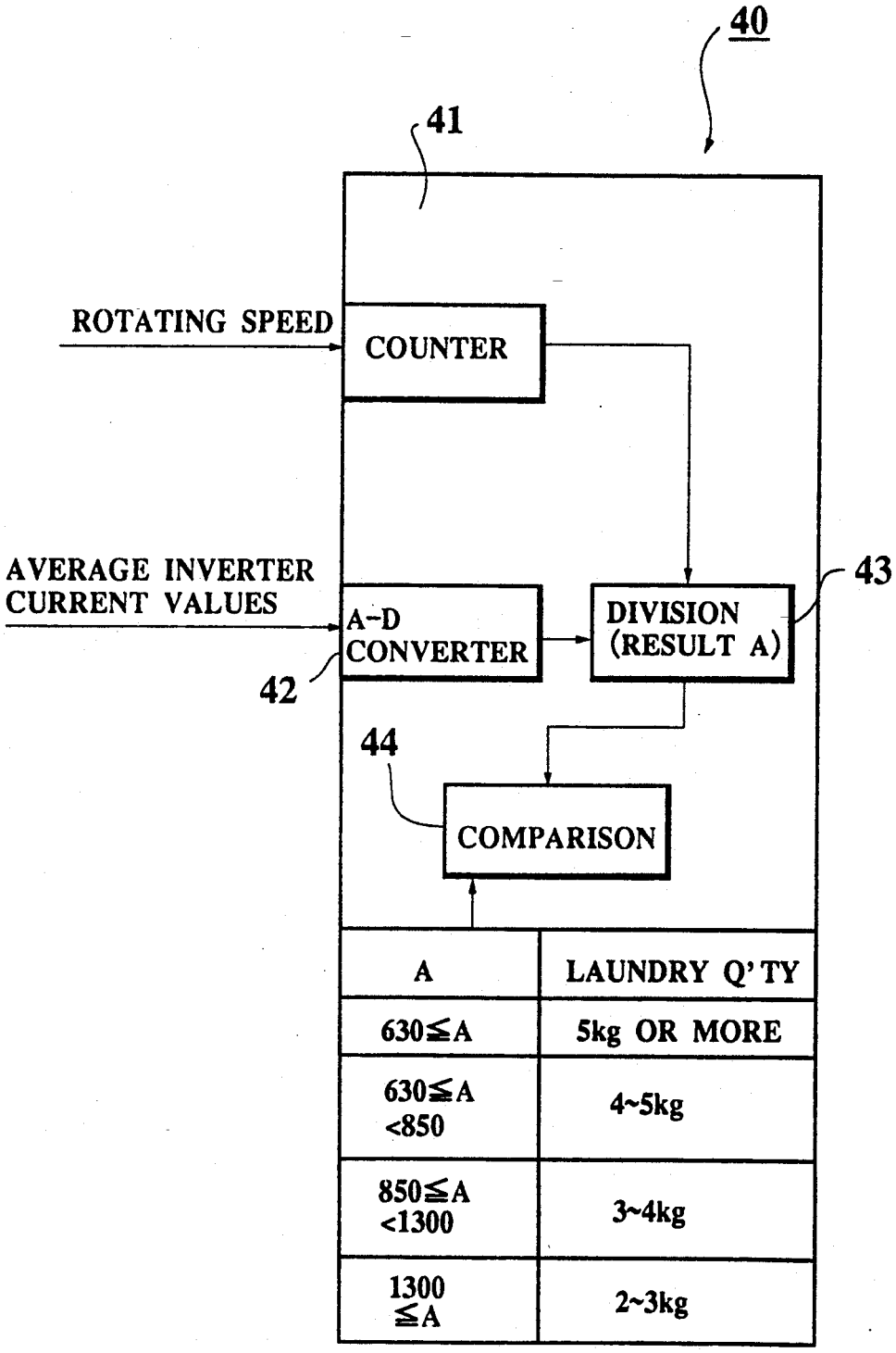
FIG. 5 is an inner-functional block diagram for microcomputer according to the present invention.
Figure 6:
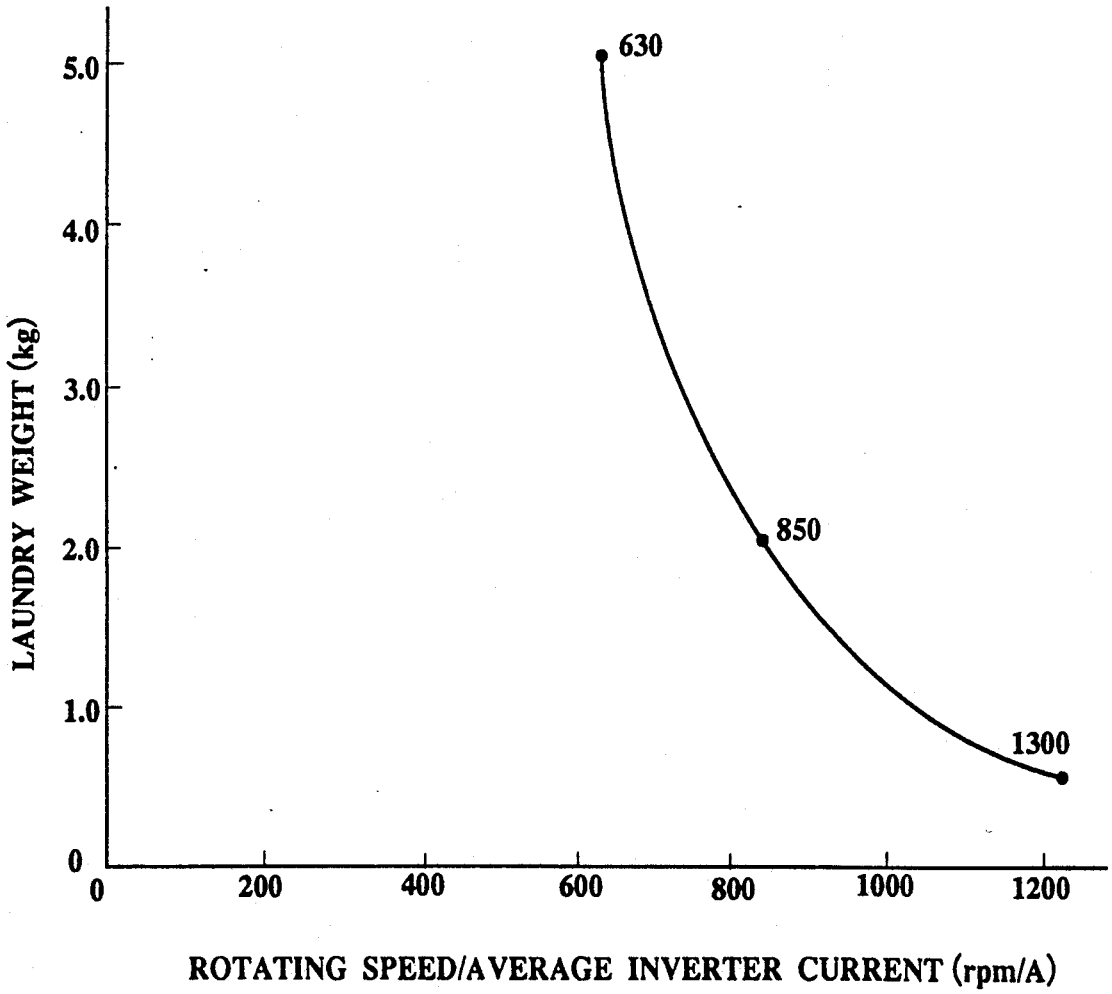
FIG. 6 is a graph showing a relation between the ratio of the DC brushless motor's rotating speed over the average inverter current, and the laundry weight.

Using diagram FIG. 5, the above-mentioned process is explained in detail. The rotating speed of the DC brushless motor is calculated in a counter 41 (step 25) and the averaged value of the inverter current is forwarded to the A-D converter 42. The rotating speed is divided by the averaged inverter current in a division portion 43 (step 26). Let us call the quotient in the step 26, A. The laundry amount is sensed accurately (steps 27–31) by a comparator portion 44 that compares the value A and the pre-set values based on the laundry weight characteristics table corresponding to the ratios of the rotating speed over the averaged inverter current value shown in FIG. 6.

The above-described sensing signal output activates the water-level setting circuit 50, and the water level in the wash tank is accordingly set the washing process begins. The DC brushless motor 20 of which the rotating speed is adjustable is employed to drive the pulsator in the washing machine according to the present invention. Therefore, the rotating speed is freely adjustable in accordance with the laundry amount sensed at each process of wash, rinse and dry, etc., thus improving the efficiencies in washing and drying, etc.

The laundry amount can also be calculated directly from the averaged inverter current and the rotating speed (rpm). In this case, the correlation between the averaged inverter current and the rotating speed (rpm) is preset in the microcomputer 40 with the threshold values set up in the manner shown in FIG. 7.

Figure 8:
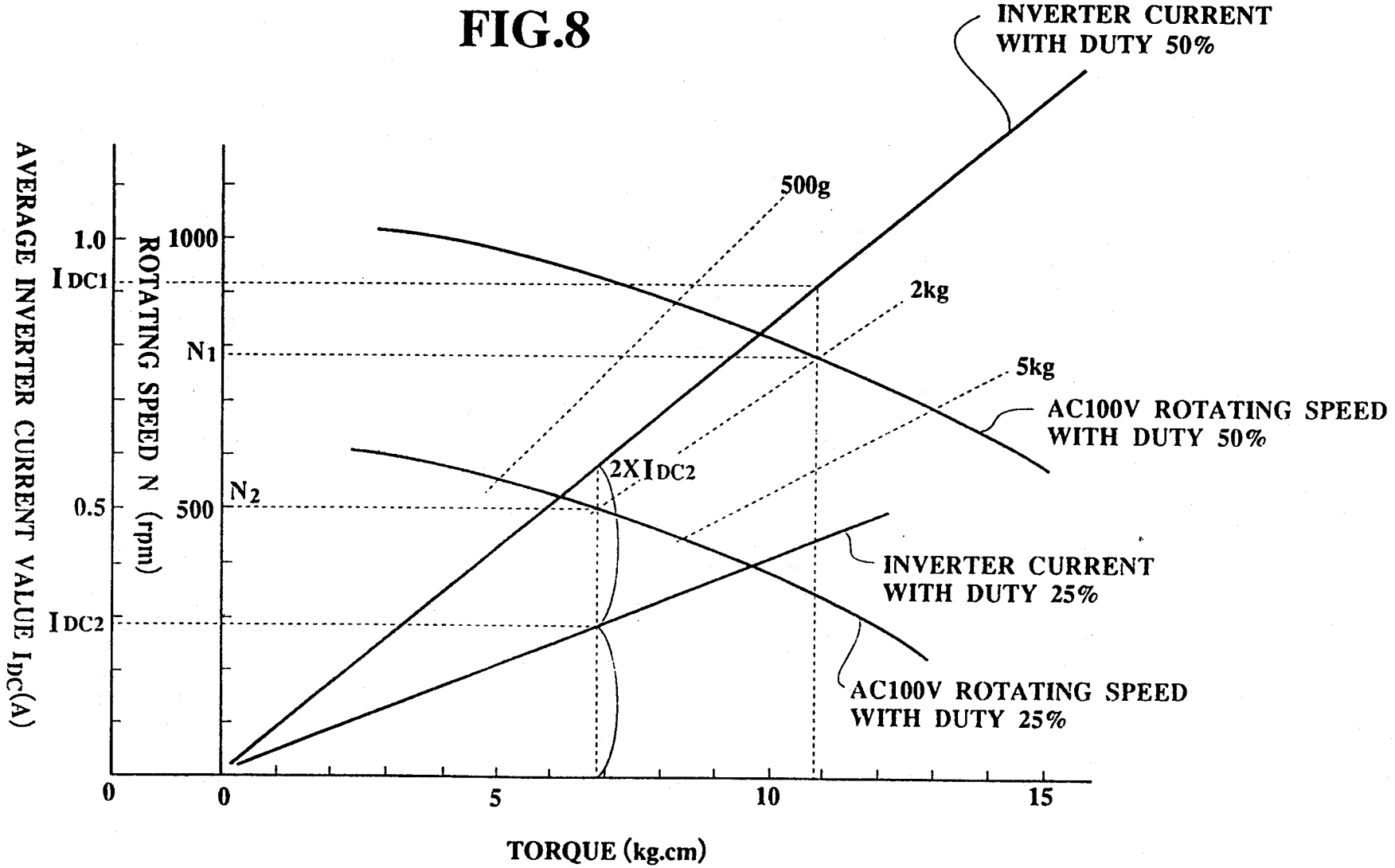
FIG. 8 is a graph showing a relation between the torque, the average inverter current and the rotating speed according to the second embodiment of the present invention.

FIG. 8 shows another embodiment of the present invention. In this second embodiment, the laundry amount is detected using the rotating speed (rpm) of the DC brushless motor 20 and the averaged inverter current measured at a plurality of points with the on-state duty of, say, 50% and 25% for the transistors $u_1$, $v_1$ and $w_1$ of the three-phase bridge-type inverter. In this case, the averaged inverter current value against the torque T with on-state duty of 25% is the half of that with an on-state duty of 50%. As indicated in FIG. 8, the rotating speed with an on-state duty of 50% is represented by $N_1$, the averaged inverter current value with an on-state duty of 50% by $I_{DC1}$, the rotating speed with an on-state duty of 25% by $N_2$ and the averaged inverter current value with on-state duty of 25% by $I_{DC2}$. When the $I_{DC2}$ is doubled ($2\times I_{DC2}$), it becomes a point on the curve of torque and inverter current with duty 50%. This means that the $I_{DC1}$ and the ($2\times I_{DC2}$) are proportionally related over the torque, so that the load of laundry can be detected. When more than three such points are set up in the same manner as above to obtain a load torque by calculating the slope of the line, the laundry amount can be further accurately detected. Accordingly, this method is also free from the effect of the commercial power supply voltage fluctuation.

In the above-described embodiment, the output control of the three-phase full-wave bridge type inverter 10 is carried out repeatedly by adjusting the on-state duties of the transistors $u_1$, $v_1$ and $w_1$ with the frequency kept constant. However, the output can also be controlled by adjusting the on-off periods. The sensor which detects the inverter current may be a current transfer including hall elements instead of the resistor.

In summary, according to the present invention, the laundry amount is detected based on the inverter current flowing through the inverter circuit with the switching device's control state kept constant and the rotating speed of DC brushless motor, in the washing machine employing the DC brushless motor to drive the pulsator. Consequently, the motor current and the inverter current are interrelated to each other, and the inverter characteristics against the torque with the control state of the switching device, say, an on-off duty ratio, being kept constant, remains steady regardless of the level of commercial power supply voltages. Therefore, the most efficient laundry is carried out with the optimum water level by accurately detecting the laundry amount even if usual commercial power supply voltage fluctuations occur during washing.

Various modifications will become possible for those skilled in the art receiving the teachings of the present disclosure without departing from the scope thereof.

What is claimed is:

1. A washing machine, comprising:

a DC brushless motor for driving a pulsator;

inverter circuit means for periodically switching an input DC voltage applied to the DC brushless motor;

inverter circuit controlling means for adjusting outputs of the inverter circuit means by controlling a switching device in the inverter circuit means and for supplying the outputs to the DC brushless motor; and detection means for detecting a laundry amount based on a rotating speed of the DC brushless motor and an average inverter current flowing through the inverter circuit means, wherein the laundry amount is detected based on a ratio of the average inverter current over the rotating speed of the DC brushless motor, with a control state of the inverter controlling means being kept constant.

2. The washing machine as set forth in claim 1, wherein the detection means is constructed to prepare a threshold value table of the laundry amount related to both the average inverter current and the rotating speed of the DC brushless motor, and then to use the threshold table to detect the laundry amount directly from the inverter current and the rotating speed of the DC brushless motor.

3. The washing machine as set forth in claim 1, wherein the detection means is constructed to accurately detect the laundry amount regardless of a level of input power supply voltage fluctuations.

4. The washing machine as set forth in claim 1, wherein the detection means is constructed to detect the laundry amount by measuring the average inverter current and the rotating speed of the DC brushless motor at a plurality of points with each fixed ON duty ratio to obtain a load torque.

5. The washing machine as set forth in claim 1, wherein the outputs of the inverter circuit are controlled by adjusting an ON duty or an ON-OFF period.

6. The washing machine as set forth in claim 1, wherein the detection means includes a resistor and/or a current transfer including hall elements for detecting the average inverter current.

* * * * *